United States Patent [19]

Emmerich

[11] 4,190,128

[45] Feb. 26, 1980

[54] ROOF DRILL BIT WITH HEXAGONAL BODY PORTION

[75] Inventor: Kenneth C. Emmerich, Lexington, Ky.

[73] Assignee: Fansteel Inc., North Chicago, Ill.

[21] Appl. No.: 971,844

[22] Filed: Dec. 21, 1978

[51] Int. Cl.[2] ..... E21C 13/00

[52] U.S. Cl. ..... 175/410; 175/320; 175/415; 175/418

[58] Field of Search ..... 175/215, 415, 421, 395, 175/320, 410, 414, 47, 418, 419; 279/20

[56] References Cited

U.S. PATENT DOCUMENTS

| | | | |
|---|---|---|---|
| 3,022,840 | 2/1962 | Hohos et al. | 175/324 |
| 3,187,825 | 6/1965 | Bower, Jr. | 175/320 X |
| 3,554,306 | 1/1971 | Wilburn | 175/417 X |
| 3,774,556 | 11/1973 | Poll | 175/320 X |
| 4,019,590 | 4/1977 | Hansen et al. | 175/57 |
| 4,086,972 | 5/1978 | Hansen et al. | 175/410 |
| 4,099,585 | 7/1978 | Emmerich | 175/410 X |

FOREIGN PATENT DOCUMENTS

| | | | |
|---|---|---|---|
| 147718 | 8/1952 | Australia | 175/410 |

*Primary Examiner*—Ernest R. Purser
*Assistant Examiner*—Richard E. Favreau
*Attorney, Agent, or Firm*—Banes, Kisselle, Raisch & Choate

[57] ABSTRACT

An improved drill bit for the mining field for use as a roof drill, tunnel drill, rock boring and highway construction, both as a rotary and a rotary percussion drill, which includes a drill head with a diametrical slot positioning a brazed cutting blade, the head having a male drive shank to interfit with a female driver tube and having a maximum axial passage in the driver shank which opens to large fluid passages leading to chip slash openings in opposed quadrants of the drill bit. The drill head position has a hexagonal base portion above the drive shank with circular guiding portions in opposed quadrants adjacent the chip slash quadrant pockets.

5 Claims, 5 Drawing Figures

ROOF DRILL BIT WITH HEXAGONAL BODY PORTION

FIELD OF INVENTION

The invention relates to a roof drill bit and more specifically to a drill bit designed for drilling coal, rock, concrete, mineral ore and other hard substances.

REFERENCE TO COPENDING APPLICATIONS

Reference is made to the following copending patent applications:

Ser. No. 849,995—Filed Nov. 9, 1977 entitled "Mining Drill Bit"

Ser. No. 910,616—Filed May 30, 1978 entitled "Roof Drill Bit"

Ser. No. 940,709—Filed Sept. 8, 1978 entitled "Roof Drill and Drill Rod System"

BACKGROUND OF THE INVENTION

Bits described in the above copending applications have included drill bits with a body and a drive shank, the body having spaced prongs in opposite quadrants for supporting the cross cutter and also quadrants for serving as passages for cuttings and dust resulting from the drilling operation, the cuttings entering the drill, in suction type systems, through the openings at the base of the open quadrants and passing through the hole in the drive shank of the drill down into drive steels which are furnishing the rotative power. These bits have had a round cross-section in the lower portion of the body, in some cases reduced from the cross-section of the supporting shanks.

The present invention contemplates a hexagonal portion in the lower part of the body, the supporting quadrants of the bit with a rounded exterior extending upwardly beyond the hexagonal portion to support the tungsten carbide cross insert, and the openings to the interior of the drive shank being made in the empty quadrants intersecting portions of the hexagonal part of the body as well as portions of the open quadrant leading to the hollow part of the drill.

The object of the invention, accordingly, is to provide a hex portion on the bit body which matches the hex portion of a drilling steel to provide a smooth and continuous flow for incoming air which is being drawn up the sides of the drill and which will carry the cuttings down through the center of the drill and the drill steels.

In addition, it is an object of the invention to provide a drill body which, by reason of its shape, improves the air flow in removing the cuttings by a pumping action of the flats and the corners of the hexagonal portion as it rotates, thus preventing the plugging of the drill and the openings.

An additional feature lies in the fact that the head may be gripped with a wrench if necessary for removal from a tool.

Other objects and features of the invention will be apparent in the following description and claims in which the principles of the invention are set forth, together with details which will enable a person skilled in the art to practice the invention, all in connection with the best mode presently contemplated for the invention.

BRIEF DESCRIPTION OF THE DRAWINGS

Drawings accompany the disclosure and the various views thereof may be briefly described as.

Referring to the drawings

Figure 1:
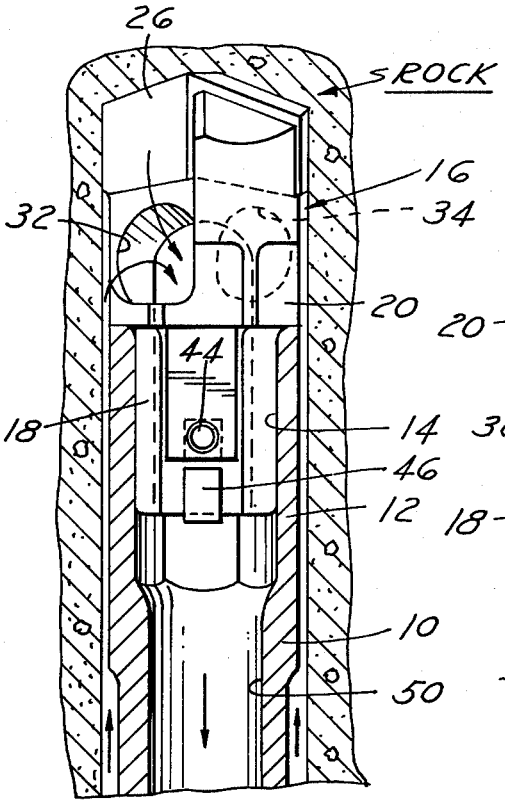
FIG. 1, a side view of an assembly of a drill steel and bit partially in section.

A drill steel 10 having a hexagonal driving portion 12 with a hexagonal inner socket recess 14 is illustrated. A drill bit 16 has a male driving shank 18 which is acircular in cross-section, preferably hexagonal, to fit into and engage the drill steel socket, and a body portion above the drive shank which comprises a hexagonal portion 20 from which rises supporting prongs 22 and 24 in diagonally opposed quadrants, each of these supporting prongs having a cross recess for supporting a spade drill insert 26 formed of a suitable grade of tungsten carbide or other hard cutting material.

Figure 3:
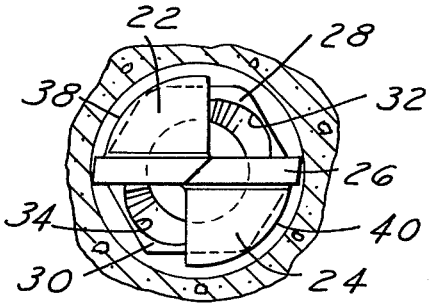
FIG. 3, an end view of the bit from the cutting end.

The bit has slash pockets 28 and 30 (See FIGS. 3 and 4) in opposed quadrants of the body adjacent the support prongs terminating at the bottom in large openings 32 and 34 which connect to the central opening 36 in thedrive shank 18. To obtain maximum air flow, the opening 36 in the male shank is as large as possible while still maintaining a wall thickness to provide the necessary strength.

The spade drill insert 26 preferably projects outwardly in a radial direction beyond the rounded sides of the supporting prongs a distance of 3/64 to 1/16" to obtain a preferred cutting action while minimizing the possibility of fracture of the insert. This projection creates a hole slightly larger than the bit body dimensions and the drill steel so that air may be supplied to the drill bit along the sides of the hole, the air being drawn in by the sub-ambient pressure in the drill steel and bit. A 30° clearance angle will be provided on the support prongs when needed to prevent dragging of the bit body.

It will be noted that the supporting quadrants 24 and 22 have circular surfaces 38 and 40 which extend beyond the hexagonal walls of the base portion 20 of the bit although these circular portions have a smaller diameter than the outer, side cutting edges of the cutting insert. It will be noted that the slash openings or pockets 28 and 30 extend down to truncate certain of the flat sides of the polygonal portion 20 of the bit.

The drill steel has a side port 42 which receives a button 44 of a U-shaped spring fastener 46. Depressing of the button 44 out of a registering hole in the bit will permit the bit to be removed from the drill steel.

The bit described is intended to be used in what is called a suction operation wherein sub-ambient pressure is created in the drill steel passage 50, this being transmitted through the opening 36 in the drive shank of the cutter bit and the large cross ports 32 and 34 to the restricted dimension of the bit at the hexagonal part. The hexagonal portion 12 of the drill steel and the hexagonal portion 20 of the drill bit are preferably the same shape and dimension to facilitate the air flow from the sides of the drill string to the ports 32 and 34. The drills are frequently used to drill roof holes and thus the drillings are falling from the cutting edges of the drill. It is thus desirable to have cuttings coarse enough that they will not slip into the sides of the drill but be carried into the scavenger ports. Thus, air will flow around the drill shank and the bit into the openings 32 and 34, and thus will carry the drillings in the form of chips and dust down through the driving steels to a collector chamber.

Figure 2:
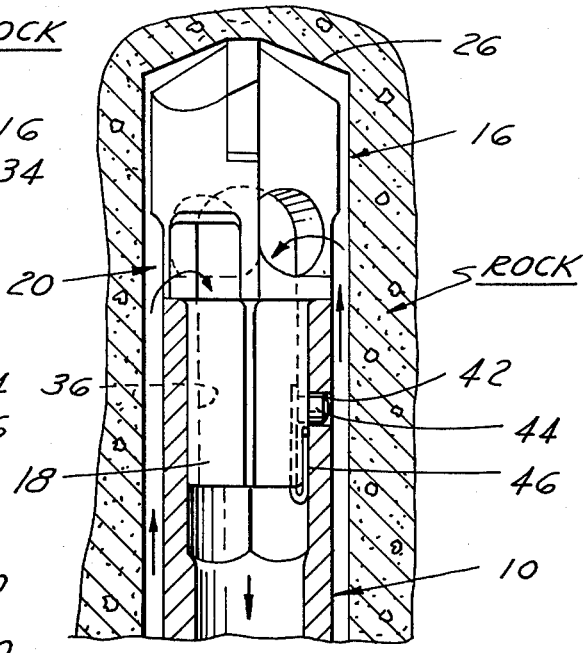
FIG. 2, a side view of the bit and drill steel rotated 90° from the position of FIG. 1.
Figure 4:
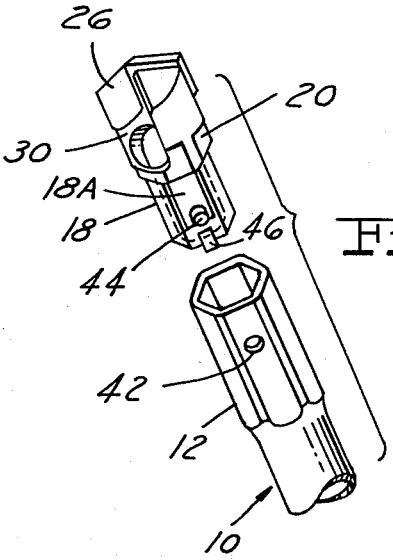
FIG. 4, a view of the bit and drill steel shown in unassembled relation.

The provision of the hexagonal portion on the bit body not only provides an interfit with the drill steel to create longitudinal air passages as shown best in FIGS. 2 and 4, but it also creates a centrifugal pumping action which, in conjunction with lowered pressure in the drill, moves the cuttings into the interior of the drill and avoids pile up and plugging of the hole so that effective drilling is possible. This is particularly important when the bit may run into very soft material which tends to pack around the drill bit.

The hexagonal body portion 20 also permits manual gripping of the bit or the application of a tool to move it, if necessary, should it become accidentally jammed in the drill steel. This avoids the necessity of applying mechanical force on the cutting insert.

Figure 5:
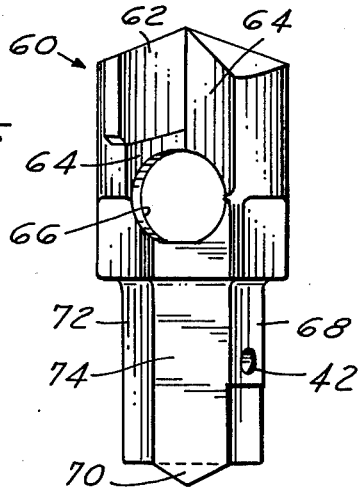
FIG. 5, a view of a modified bit having at the shank end of the bit an identifying projection.

In FIG. 5, a modified bit is shown wherein the hexagonal flats are indexed from the showing in FIGS. 1 to 4. In FIG. 5, the bit 60 has a cross insert 62 with the supporting prongs 64. Cross ports 66 compare with ports 32 and 34 in the previous figures. A hexagonal drive shank 68 is integral with the body. At the bottom of one hex flat on the shank is a small triangular tab 70 projecting axially to serve as an identification device.

In FIG. 5, the flat side 72 and the side opposed to it are square with the ends of the insert 62 placing the flat 74 substantially aligned with the ports 66. In FIGS. 1 to 4, the flat 18A and its opposite side are flat with the flat sides of the insert 26 which orientation operates more efficiently and is the preferred embodiment. The bits are operated at 250 to 550 R.P.M. and preferably at about 450 R.P.M. Thus, the rotation of the flats on the bit directly adjacent the suction holes 32, 34 or 66 creates the pumping action which assists the vacuum action of the system.

Reverting to the tab 70, it will be appreciated that starting bits are in general larger than the bits used to finish the hole. Thus, once a hole is started, it is critical that a proper finishing bit be used. The male hexagonal drive shank makes it possible to place this tab at the insertion end of finishing bits. In poorly lighted mines, this size identification by feel can be important since an oversize hole could cause great difficulties when resin-system roof bolting or mechanical roof bolting is to be inserted for roof reinforcement.

The improved bit has proved in tests to be significantly better than competitive bits. A drilling speed of 10.15 feet per minute was achieved with the disclosed bit with no plugging or puffing, while a competitive bit in similar material produced only 4.13 feet per minute.

What is claimed as new is as follows:

1. A mining drill bit for rotary and rotary percussion drilling of hard materials such as rock, coal, concrete and the like which comprises:

(a) a generally cylindrical metallic body having a base portion with a polygonal shape in cross-section with flat sides, (b) an acircular driving shank of substantially smaller diameter than said body axially disposed on one end of said body having a cooling passage formed therein extending to said body, (c) support prongs extending axially on said base portion in diametrically opposed quadrants having aligned ledge surfaces to support a bottom of a cutting insert and axially extending chordal surfaces in contact with trailing sides of said insert on opposite sides of the center of said body, (d) an insert secured to surfaces of said prongs, (e) the remaining quadrants in said body being formed to provide chip slash openings extending into said base portion to form ports connecting the cooling passage of said shank with said slash openings.

2. A mining drill bit as defined in claim 1 in which each said slash opening extends into said base portion to truncate at least two of the flat sides of said polygon.

3. A mining bit as defined in claim 1 in which the outer surface of said support prongs is circular and concentric with said cylinder and the respective ends of said insert project radially outward beyond said outer surfaces to have a side cutting edge spaced outwardly from said outer surfaces.

4. A mining drill bit for rotary and rotary percussion drilling of hard materials such as rock, coal, concrete and the like which comprises:

(a) a generally cylindrical metallic body having a base portion with a polygonal shape in cross-section with flat sides, (b) an acircular driving shank of substantially smaller diameter than said body axially disposed on one end of said body having a cooling passage formed therein extending to said body, (c) support prongs extending axially on said base portion in diametrically opposed quadrants having aligned ledge surfaces to support a bottom of a cutting insert and axially extending chordal surfaces in contact with trailing sides of said insert on opposite sides of the center of said body, (d) an insert secured to surfaces of said prongs, (e) the remaining quadrants in said body being formed to provide chip slash openings extending into said base portion to form ports connecting the cooling passage of said shank with said slash openings, and, in combination, (f) a drill steel having a female recess to receive said acircular driving shank in a driving relationship, said drill steel having an outer polygonal configuration and dimension equal to said base portion of said bit to facilitate air flow around said drill steel and the base portion of said bit to said ports.

5. A mining drill as defined in claim 4 in which said acircular driving shank and body portion are hexagonal in cross-section.

* * * * *